US012025416B2

(12) United States Patent
Hanna et al.

(10) Patent No.: US 12,025,416 B2
(45) Date of Patent: Jul. 2, 2024

(54) AMMUNITION COLLATOR

(71) Applicant: MECTRON ENGINEERING COMPANY, INC., Saline, MI (US)

(72) Inventors: Mark L. Hanna, Ann Arbor, MI (US); Michael A. Hall, Galesburg, MI (US); Robert J. Perez, Saline, MI (US); Alexander T. Vanias, Cottage Grove, WI (US)

(73) Assignee: MECTRON ENGINEERING COMPANY, INC., Saline, MI (US)

( * ) Notice: Subject to any disclaimer, the term of this patent is extended or adjusted under 35 U.S.C. 154(b) by 162 days.

(21) Appl. No.: 17/752,145

(22) Filed: May 24, 2022

(65) Prior Publication Data

US 2023/0384071 A1 Nov. 30, 2023

(51) Int. Cl.
*F42B 33/00* (2006.01)

(52) U.S. Cl.
CPC ..... *F42B 33/002* (2013.01); *F42B 33/00* (2013.01); *F42B 33/001* (2013.01)

(58) Field of Classification Search
CPC ..... B65G 47/1457; B65G 47/1464; F42B 33/001; F42B 33/00; F42B 33/002; F42B 33/004
USPC ..... 198/396
See application file for complete search history.

(56) References Cited

U.S. PATENT DOCUMENTS 2,400,695 A * 5/1946 Jackson ..... B65B 19/34 198/429
9,989,342 B1 * 6/2018 Lougeay ..... F42B 33/002
10,527,375 B1 1/2020 Mokuolu
10,533,817 B1 * 1/2020 Hefer ..... F41A 9/83
2013/0125737 A1 * 5/2013 Koskela ..... F42B 33/002 86/45

(Continued)

FOREIGN PATENT DOCUMENTS

CN 106429336 A 2/2017
WO 2012/152968 * 11/2012 ..... F42B 33/02

OTHER PUBLICATIONS

International Search Report and Written Opinion on PCT/US2023/067346, mailed Sep. 19, 2023.

(Continued)

*Primary Examiner* — James R Bidwell
(74) *Attorney, Agent, or Firm* — DICKINSON WRIGHT PLLC

(57) ABSTRACT

A collator device for receiving finished ammunition cartridges in a non-oriented condition and orienting them into a stream of aligned ammunition cartridges for downstream manufacturing or packaging processes. The device incorporates a flat, circular collator plate which rotates inside a collator can with an upstanding circular sidewall. The collator plate upper surface forms a series of radially orienting vanes. Ammunition apertures are formed around the perimeter of the collator plate interleaved between the vanes. As the collator plate is rotated, the apertures receive ammunition cartridges aligned in either a radially inward or radially outward position. Features of the apertures cause the cartridges to drop in an aligned condition as the apertures pass over a slot in the collator can backing plate. Numerous features are provided to enhance throughput and reduce damage to the components as they are handled and processed in the device.

10 Claims, 13 Drawing Sheets

(56) References Cited

U.S. PATENT DOCUMENTS

| | | | | |
|---|---|---|---|---|
| 2013/0152771 | A1* | 6/2013 | Coma Asensio | F42B 33/002 86/19.5 |
| 2018/0156591 | A1 | 6/2018 | Lougeay et al. | |
| 2020/0278185 | A1 | 9/2020 | Chicoine | |

OTHER PUBLICATIONS

Zhong, M., et al., CN 106429336 A, filed Feb. 22, 2017, English Translation.

* cited by examiner

AMMUNITION COLLATOR

FIELD OF THE INVENTION

The invention relates to a collator for orienting firearm ammunition in an assembly stream.

BACKGROUND

In the production of firearm ammunition such as that use for rifles, handguns and other firearm systems, it is necessary to complete a number of assembly tasks including, for example, producing the basic components of shell casing, bullet, primer, and propellant charge. These components are assembled in automated processes into finished ammunition cartridges. Following assembly, cartridges are typically subjected to a number of additional processing steps such as inspection, packaging, etc. In these processes, there is a need to provide a collator device, which receives bulk finished cartridges and arranges them in an ordered manner for downstream processes. While collator devices are known, further improvements in such devices are desired to enhance their accuracy, throughput rate, and their ability to handle cartridges in a manner, which does not degrade their function or appearance. A particular issue with existing collator devices is their tendency to cause cosmetic and potentially functional defects of the surfaces, principally of the shell casings caused by rough handling of the ammunition as they collide with each other and components of a collator. Embodiments of the present invention provide a collator device with enhanced operation capabilities.

SUMMARY

Embodiments of collator devices described herein permit efficient collating of ammunition cartridges while minimizing damage to the cartridges associated with handling, while providing high throughput rates and accuracy.

DETAILED DESCRIPTION

Figure 1:
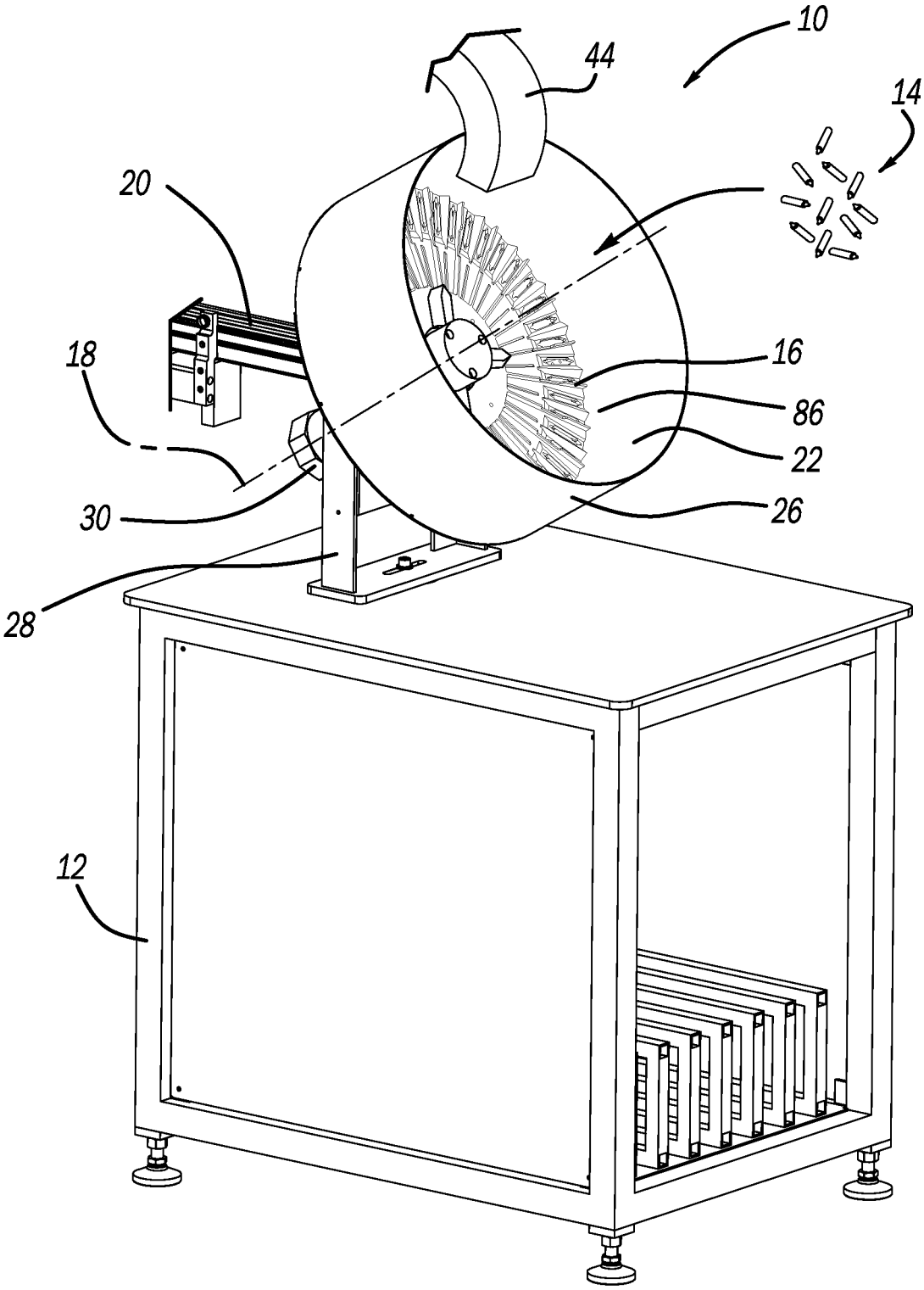
FIGS. 1 and 2 are pictorial views of a collator device in accordance with the present invention mounted to a base.
Figure 2:
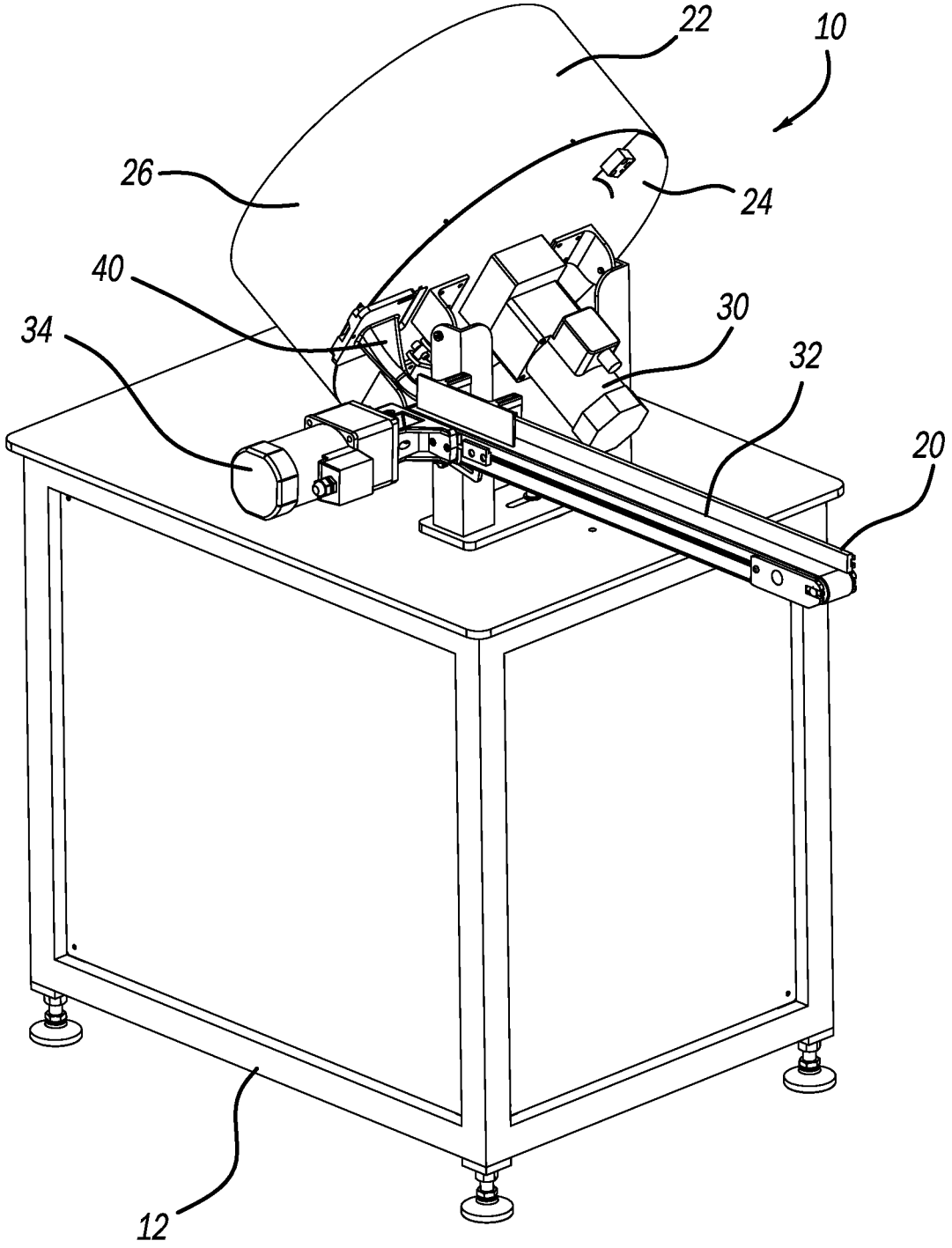

With particular reference to FIGS. 1 and 2, collator assembly 10 is shown amounted to a machine base 12. Collator assembly 10 is provided for orienting ammunition cartridges 14 as will be described in detail as follows.

Collator assembly 10 principally comprises a rotating collator plate 16 which rotates about axis of rotation 18, which is tipped from a horizontal plane by about 30° (in accordance with one exemplary embodiment). Discharge track 20 receives a stream of ammunition cartridges 14 arranged in an oriented string manner which can be coupled with downstream processes such as surface inspection devices, dimensional inspection devices, other inspection systems, packaging, etc. (not illustrated). Collator can 22 has a circular base 24 and an annular sheet metal cylinder or sidewall 26. Collator can 22 is fixed mounted to a mounting frame 28. The components are dimensioned such that there is a small gap at the outer perimeter 17 of collector plate 16 to the inside surface of collator can 22 around the outer perimeter of the collator plate. Drive motor 30 is mounted to frame 28 and provide rotation of collector plate 16.

Figure 3:
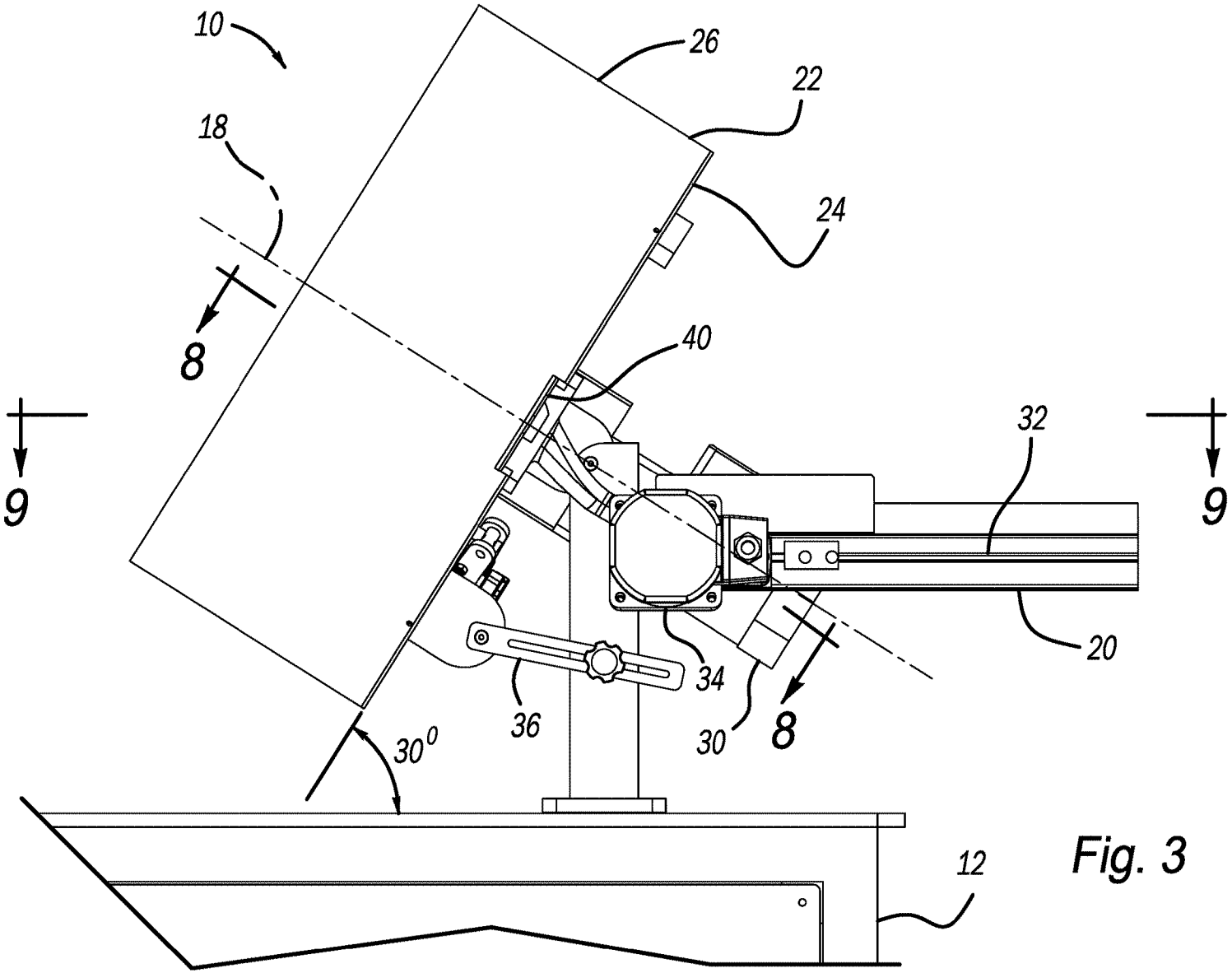
FIG. 3 is a side view of the collator device.

FIG. 2 provides additional details of the collator assembly 10. Discharge track 20 includes a conveyor belt 32 driven by drive motor 34. As shown in FIG. 3, angle adjustment bracket 36 allows the tipping plane of collator plate 16 and collator can 22 to be adjusted.

Figure 5:
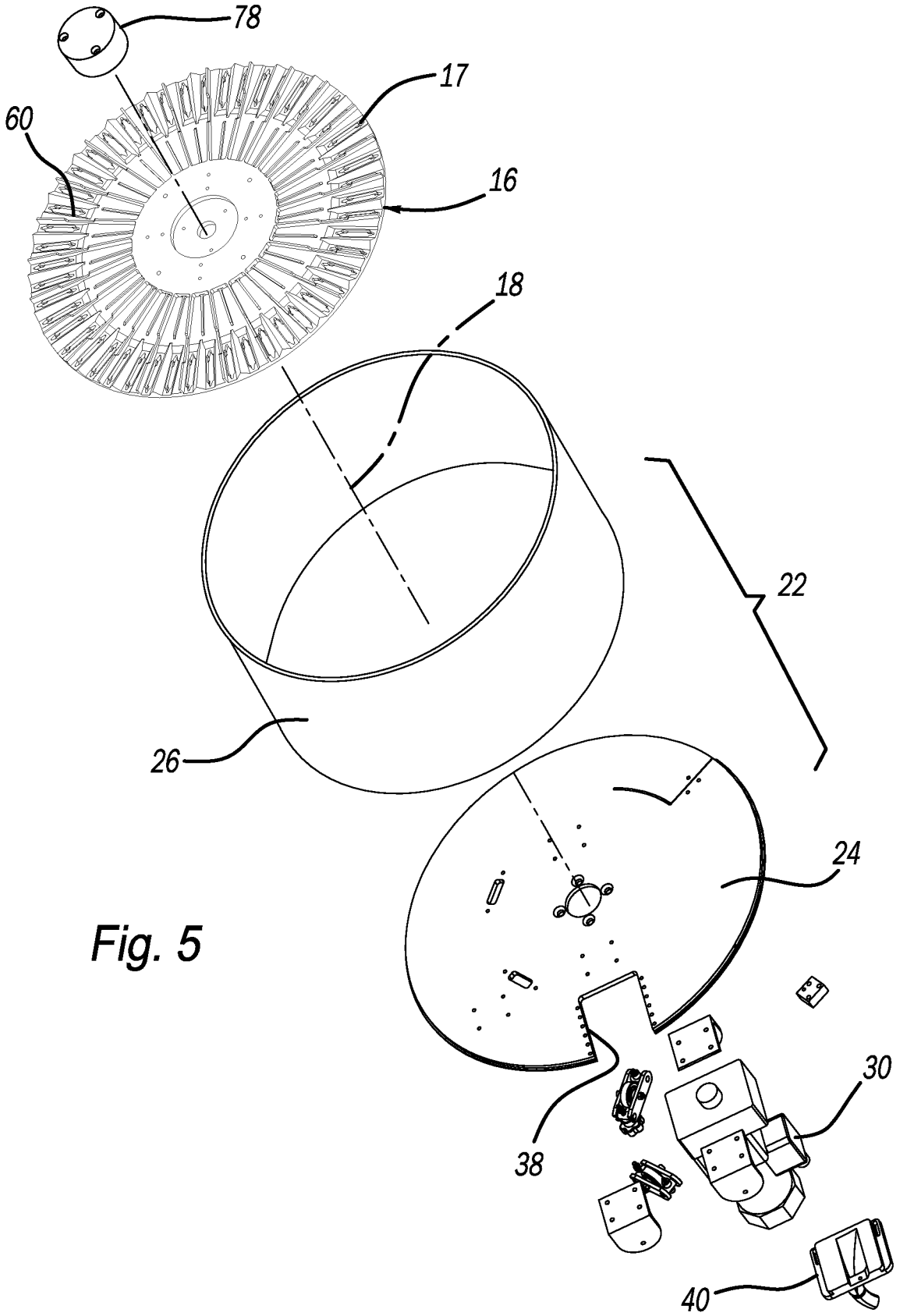
FIG. 5 is an exploded pictorial view certain components of the collator device.
Figure 6:
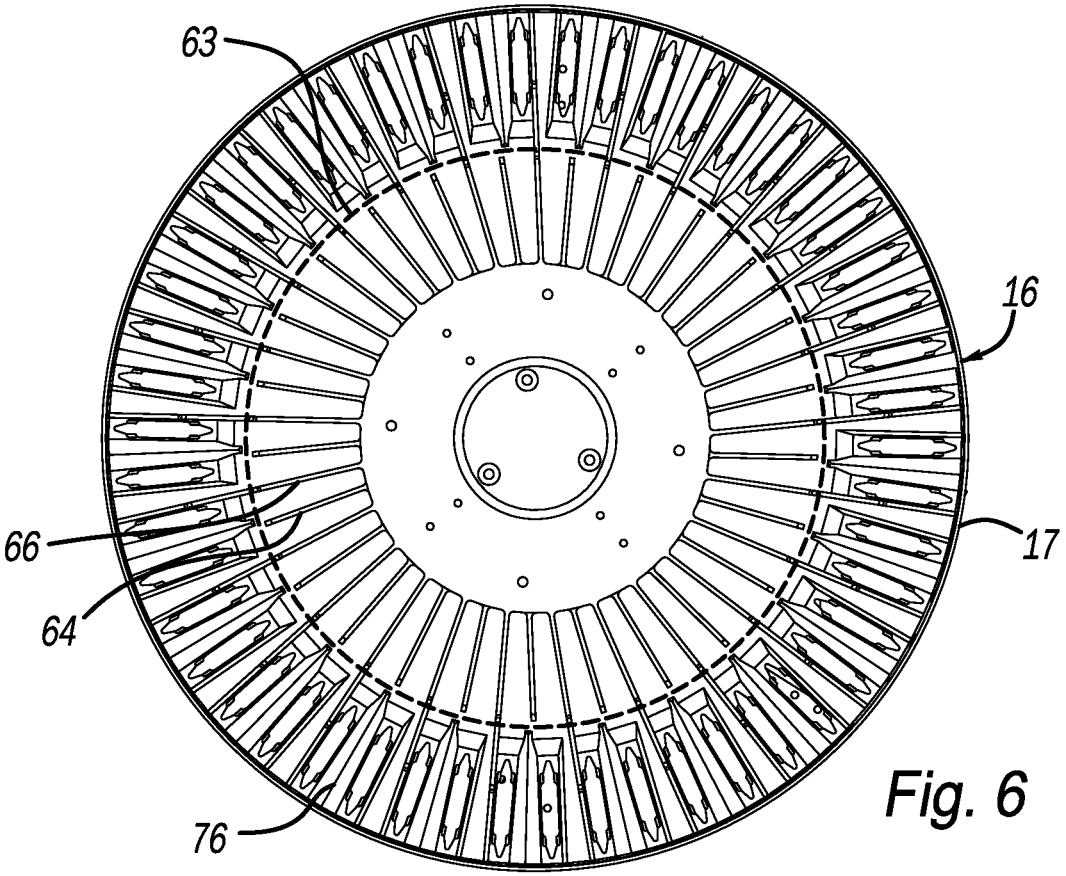
FIG. 6 is a top elevational view of the collator plate.
Figure 7:
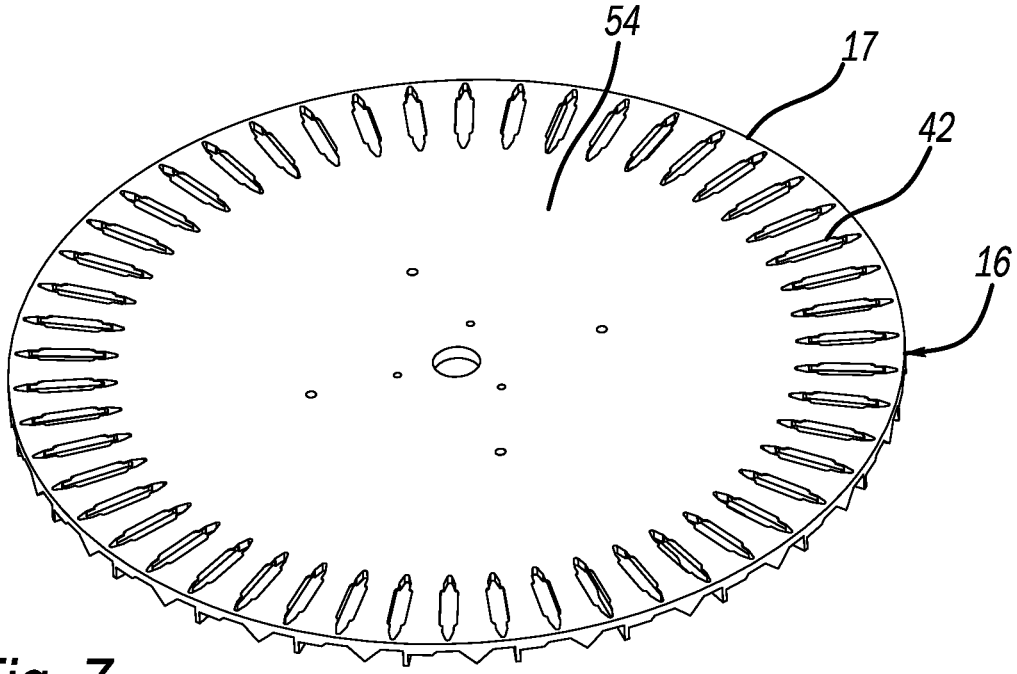
FIG. 7 is pictorial view, particularly showing the bottom surface of the collator plate.

As shown in the exploded view of FIG. 5, collector can 24, features, discharge slot 38. Discharge chute 40 is attached to base 24 surrounding discharge slot 38 and receives oriented ammunition cartridges 14 and feeds them onto discharge track conveyor belt 32.

As an introductory broad description of the function of collator assembly 10, loosely arranged and non-oriented ammunition cartridges 14 are fed from a bulk supply stream into the interior cavity of collector can 22 by feed chute 44 and interact with collector plate 16 as will be described in detail. Ammunition cartridges 14 received by collator plate 16 are oriented and are discharged through apertures 42 of collator plate 16 into discharge chute 40 and are then fed onto discharge track 20.

Figure 14:
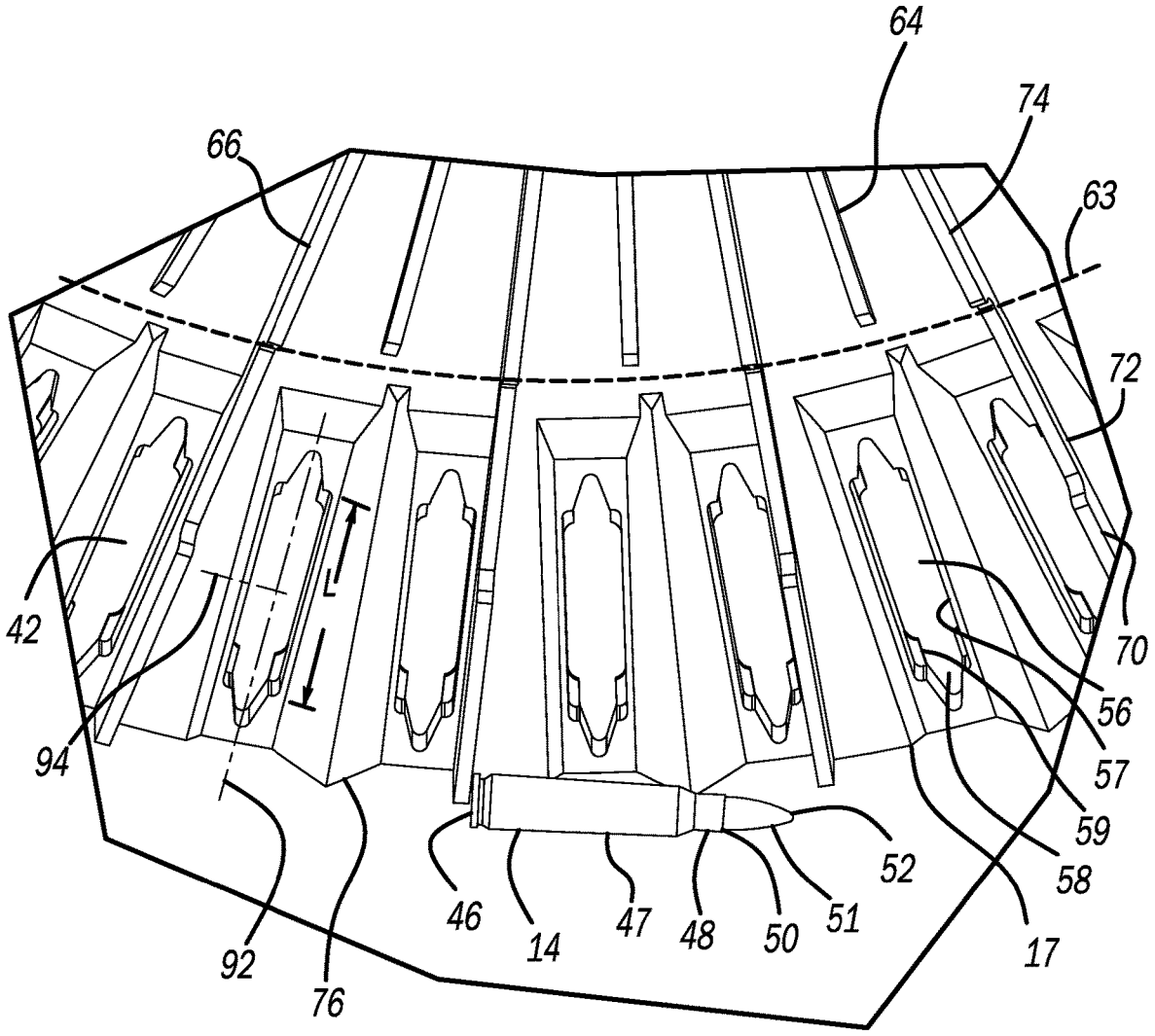
FIG. 14 is a partial view of the diverter plate showing features of the plate to prevent ammunition cartridges from being trapped along the outer perimeter of the collator plate.

Collator assembly 10 as described by this embodiment is especially adapted for handling ammunition having certain configuration features. As shown in FIG. 14, cartridge 14 has head 46 and a shell body 47 having a necked-down down portion 48 which terminates at an open mouth 50, receiving bullet 51 having typically a reduced diameter or pointed tip 52.

Now with reference to FIGS. 6, 7 and 10-14, collector plate 16 includes a number of design features which enhance the function of the system. Collector plate 16 may be machined from a flat, circular billet of aluminum (or other material). The bottom surface 54 is generally flat although a series of discharge apertures 42 are shown which pass through the plate. Discharge apertures 42 are symmetric about a radial axis 92 and their circumferential midplane axis 94 and form a center section 56 with parallel wall edges 57 with narrowing end sections 58 which provide clearance for ammunition bullet 51. A pair of lands 59 are formed adjacent to end sections 58. The length L of apertures 42 is shown in FIG. 14, and is measured from the terminal end of end section 58 and the base of lands 59 is selected to be just slightly greater than the overall length of cartridge 14. The double ended and symmetric form of apertures 42 plays an important role in orienting cartridges as will be described below.

Collector plate top surface 60 includes a number of significant configuration features. The central proportion 62 is a flat surface and radiating outwardly from the central portion 72 are a number of vanes divided into two groups, which are interleaved radially. Collector plate top surface 60 forms an imaginary circle 63 having a diameter roughly between one-third and two-thirds the diameter of the collector plate (in one set of exemplary embodiments). Vanes 64 do not extend to the outer perimeter 17 of collector plate 16, but instead, radially terminate at or near circle 63. Vanes 66 extend entirely from central portion 62 to outer perimeter 17 and have a variety of heights as measured from base surface 68, including, outwardly from central portion 62, first portion 70 having a height greater than that of vanes 64, central notched portion 72 of reduced height and terminal portion 74 which extends to outer perimeter 17. Interleaved between adjacent terminal portions 74 and extending radially outwardly from about circle 63 to outer perimeter 17 are vanes 76 having a triangular cross-sectional shape (when cut along a circumference of the plate). All of vanes 64, 66 and 76 are arranged to extend from the central axis of rotation 18 toward outer perimeter edge 17. Vanes 76 are aligned with vanes 64 and are fit between adjacent vanes 66 with discharge slots 38 formed between them. The central notched portion 72 of vanes 64 is provided to help prevent cartridges 14 from becoming locked in position between adjacent vanes.

Mounted to collator plate 16 at its center is central hub 78 and a series of four diverter vanes 80 extending radially from hub 78.

Figure 4:
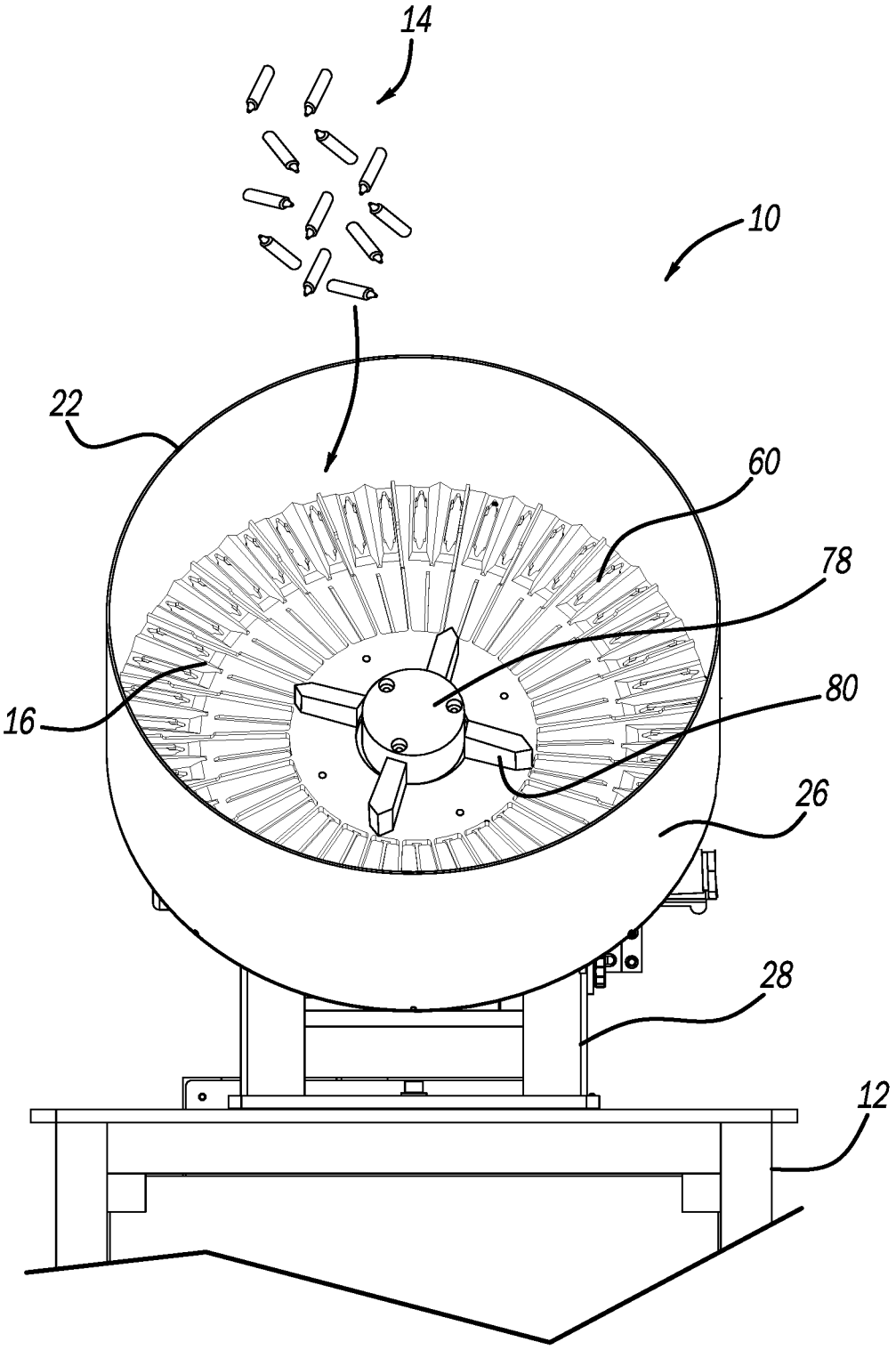
FIG. 4 is a side elevational view of the collator device.
Figure 11:
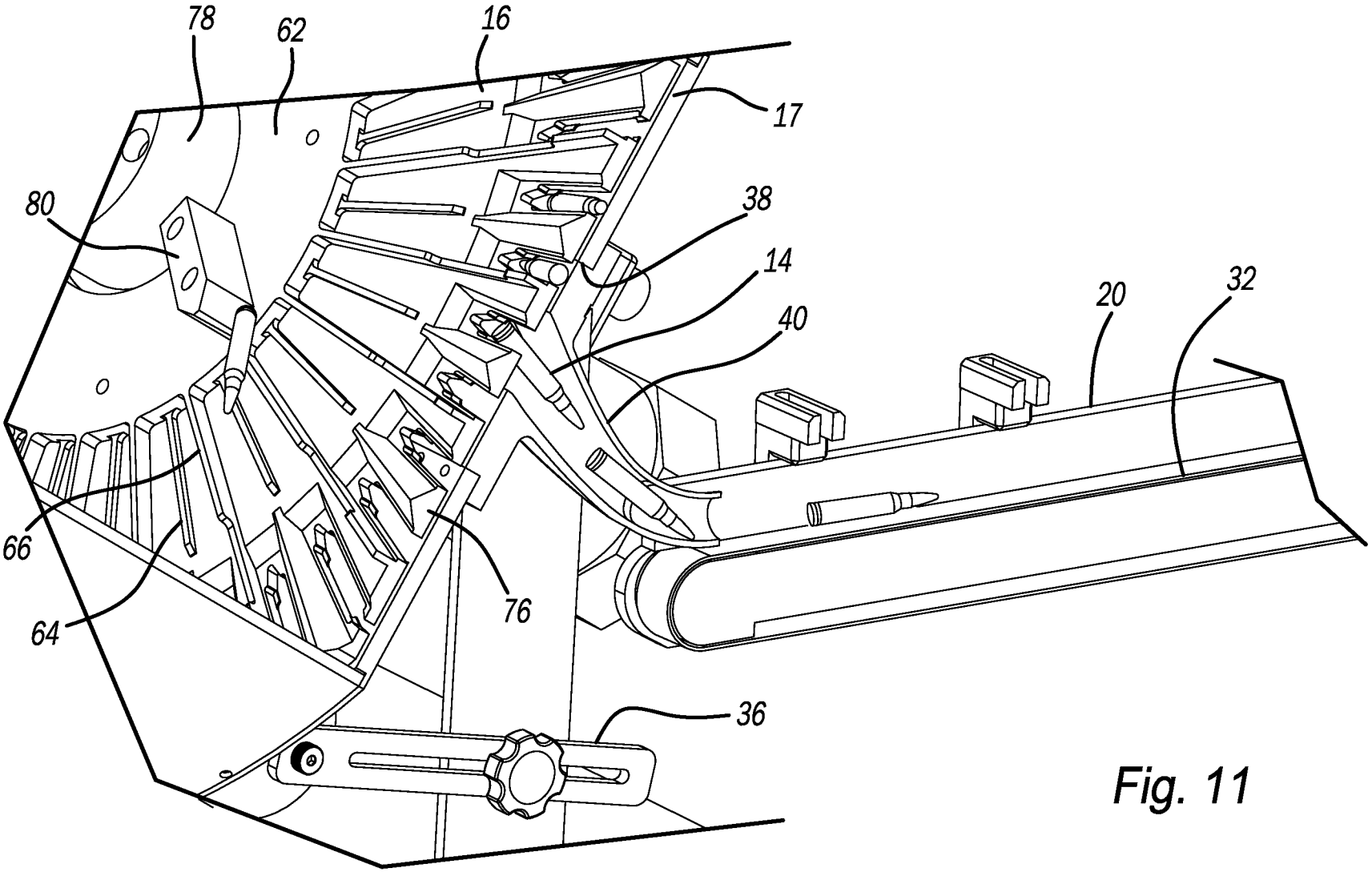
FIG. 11 is a pictorial view showing operation of the collator device in arranging ammunition for discharge.
Figure 12:
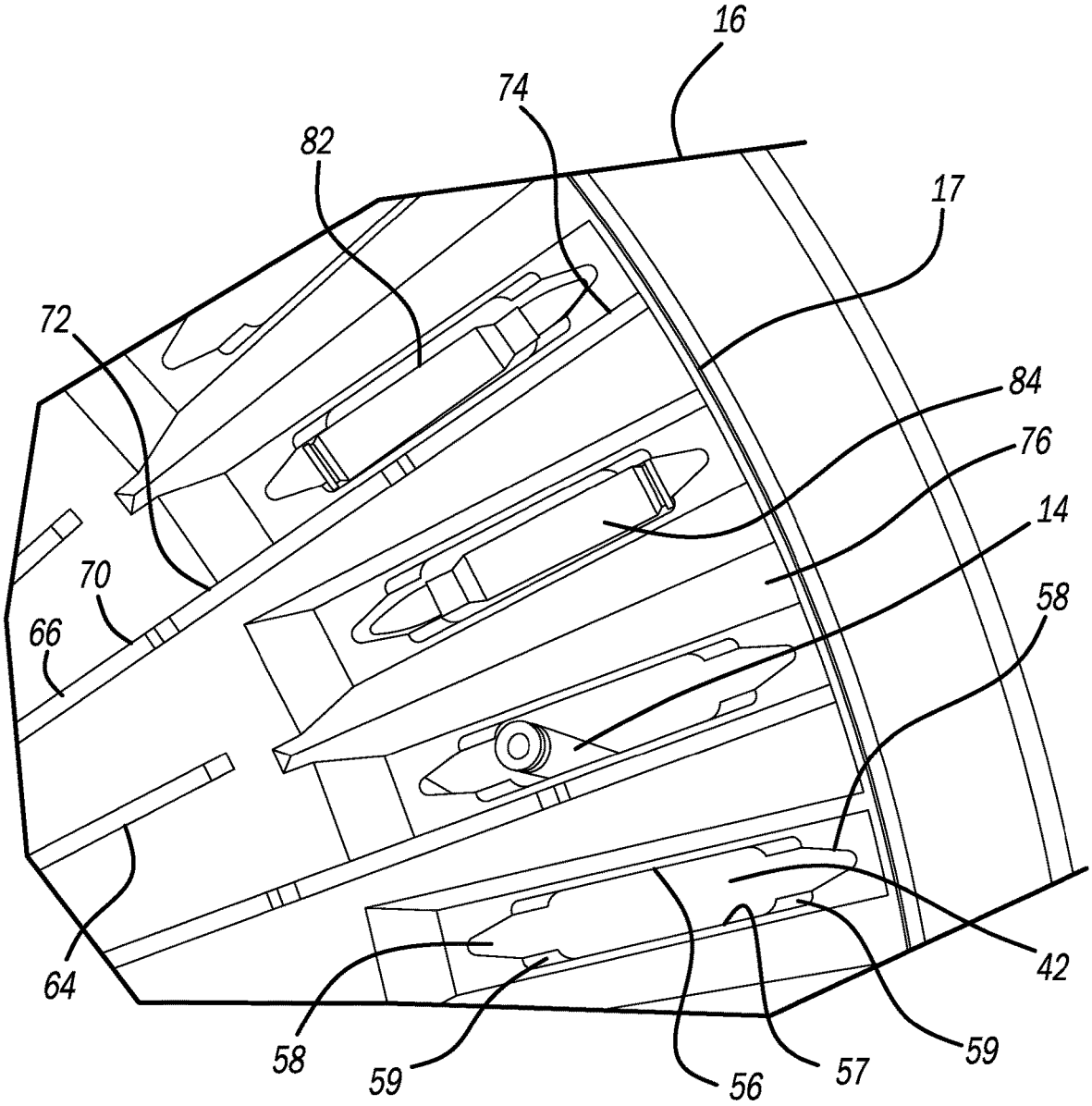
FIG. 12 is a partial pictorial view showing an ammunition cartridges dropping into the discharge slot from the collator plate.
Figure 13:
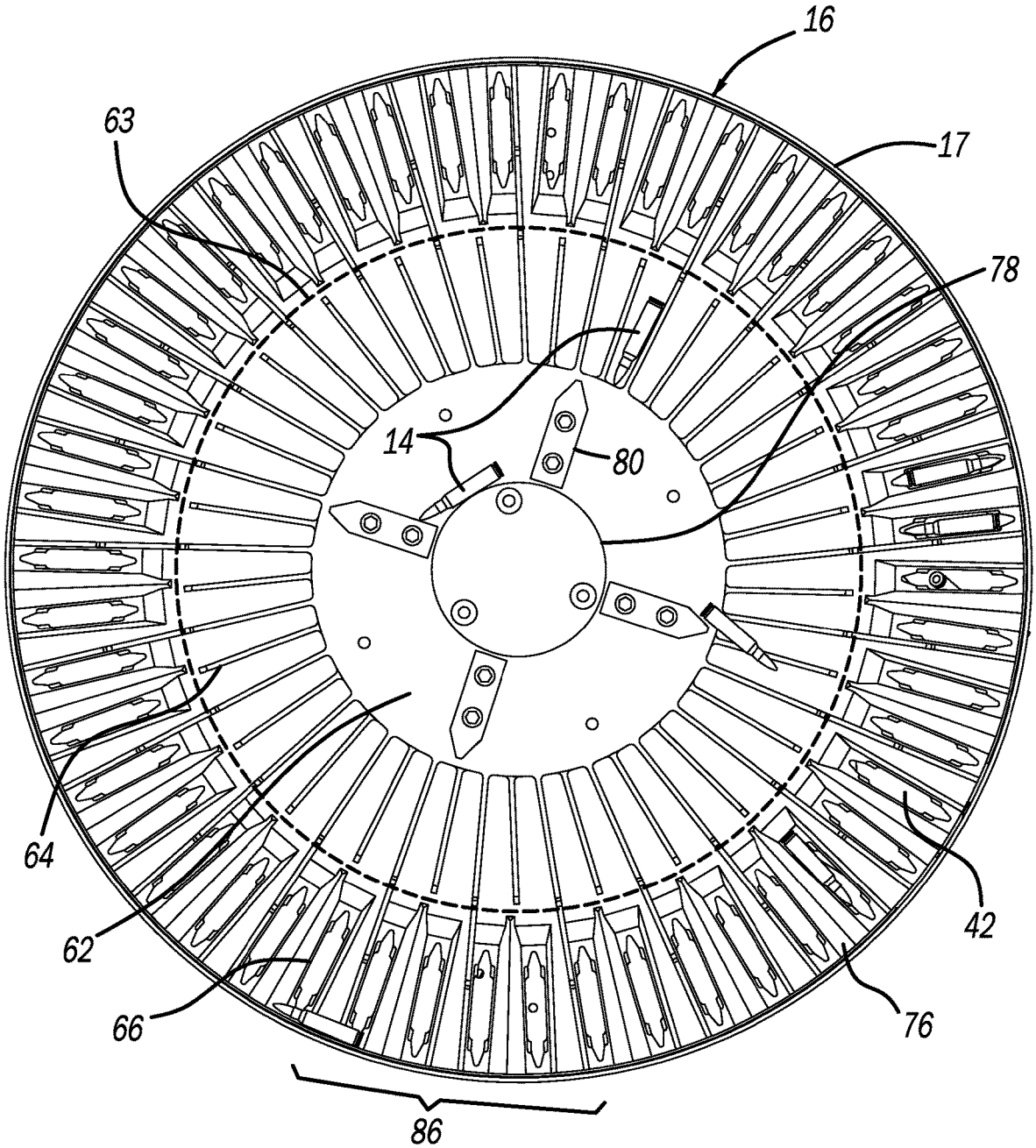
FIG. 13 is a top view of the collator plate showing operation of the diverter vanes.

Operation of collator assembly 10 will now be explained with particular reference to FIGS. 10-14. As mentioned previously, ammunition cartridges 14 are fed into the open cavity formed by collator can 22. Collator plate 16 is rotated in a clockwise direction (referring to the orientation shown in FIG. 4). Cartridges 14 are stirred and collected as collator plate 16 rotates and eventually are positioned into apertures 42 for discharge. By gravity, due to the inclination of collector plate, cartridges 14 tend to collect in the lower region 86 of can 22. It is advantageous to reduce the distance of freefall of cartridges 14 to protect them from damage when colliding with one another. Hub 78 and diverter vanes 80 prevent cartridges 14 being fed from feed chute 44 from directly falling onto the lower collection area 86 of the plate, as shown in FIG. 13. Cartridges 14 tend to become first oriented by the vanes 66 and 64 of the inner portion of collector plate 16 (inside of circle 63) and then slide by gravity into a position over apertures 42. FIG. 14 illustrates ammunition cartridges 14, which may be positioned at the bottom collection area 86. Due to the differing height of terminal portion 74 of vanes 66 and vanes 74 the cartridges tipped shown in FIG. 14, so that does not become locked between adjacent vanes. This configuration prevents cartridges 14 from becoming caught or locked into position between adjacent vanes. Referring to FIG. 12, once cartridges 14 fall into position over discharge slots 38, they can be either in an orientation where ammunition tip 52 is pointed in a radially outer direction referred to as position 82, or the tip is oriented radially inwardly at position 84. Cartridges 14 are held in position within apertures 42 by the close spacing of collector plate 16 from circular base 24 until they overlie discharge slot 38. When that occurs, they are free to fall into discharge chute 40.

Apertures 42 were previously described as to their shape. In FIG. 12, it will be noted for ammunition in position 82 (pointed outwardly) that apertures 42 at the outer end provide clearance for bullet tip 52, but its head 46 rests on the radially inner lands 59 which have a separation width less than that of the ammunition shell body 47. In a similar manner, for ammunition 14 in condition 84 (pointed inwardly) apertures 42 at the inner and provide clearance for bullet tip 52, but its head 46 rests on the radially outer lands 59 which have a separation width less than that of the ammunition shell body 47. That FIGS. 11 and 12 illustrate that cartridges 14 will fall with tip 52 facing downwardly whether they were first in position 82 or 84. In either position cartridge base 46 is supported by lands 59 until the cartridge falls into a nearly vertical orientation, whereupon it is released to fall through apertures 42 by gravity. The now oriented cartridges 14 fall into discharge chute 40 and are guided onto discharge track conveyor belt 32. As mentioned previously, this alignment orients cartridges 14 them for downstream processing.

Figure 8:
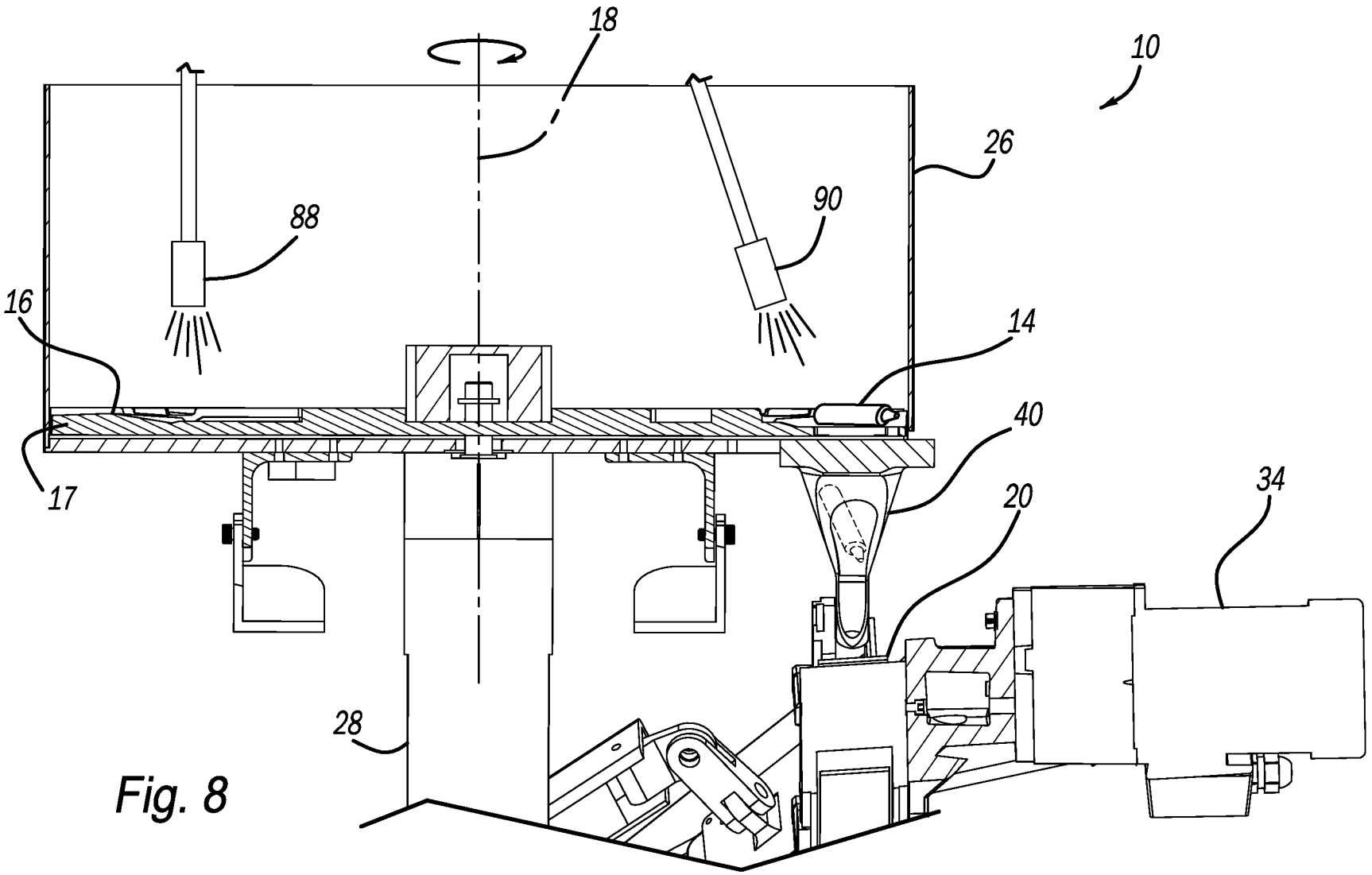
FIG. 8 is a cross-sectional view taken along line 8-8 of FIG. 3.
Figure 9:
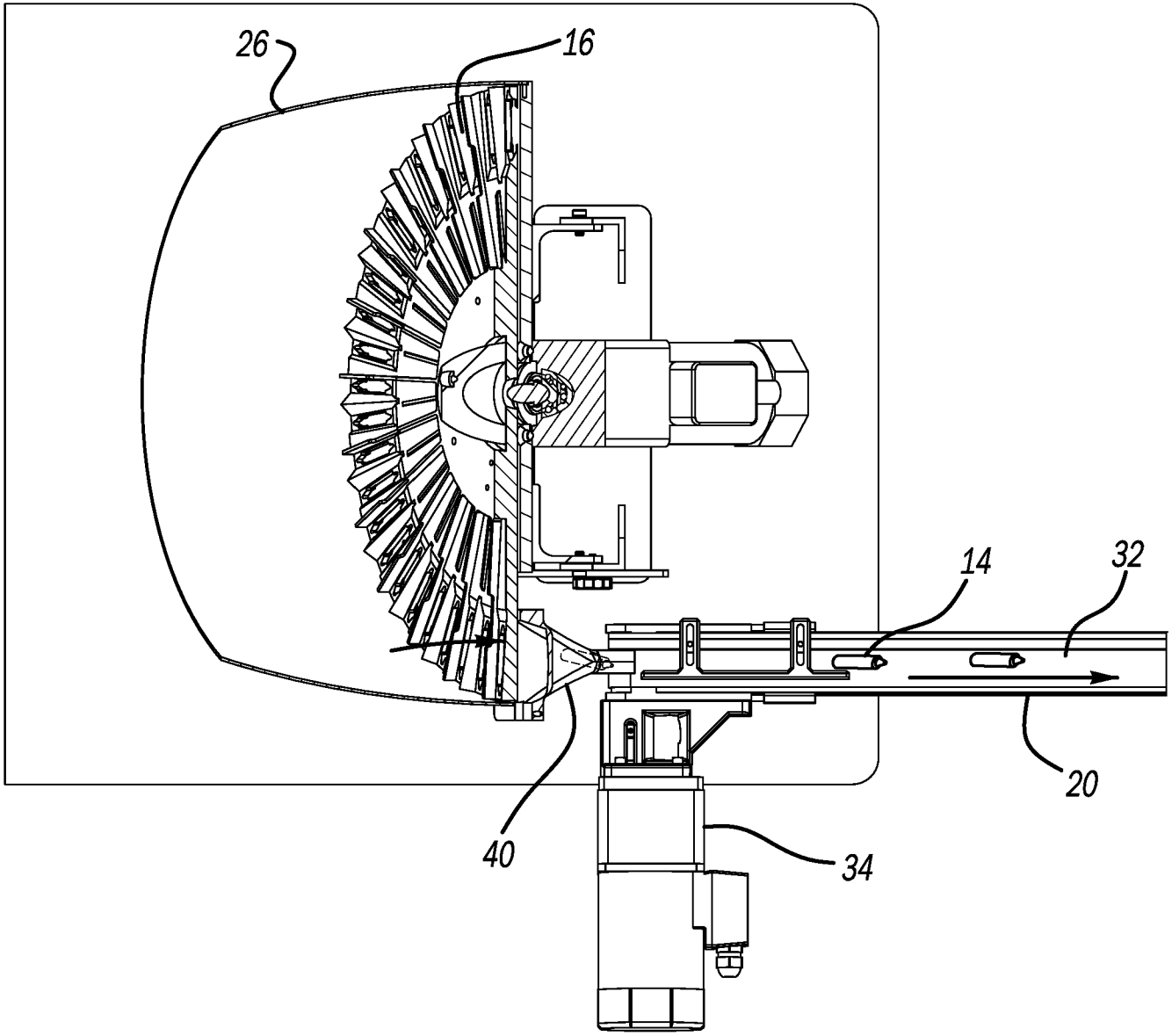
FIG. 9 is a cross-sectional view taken along line 9-9 of FIG. 3.
Figure 10:
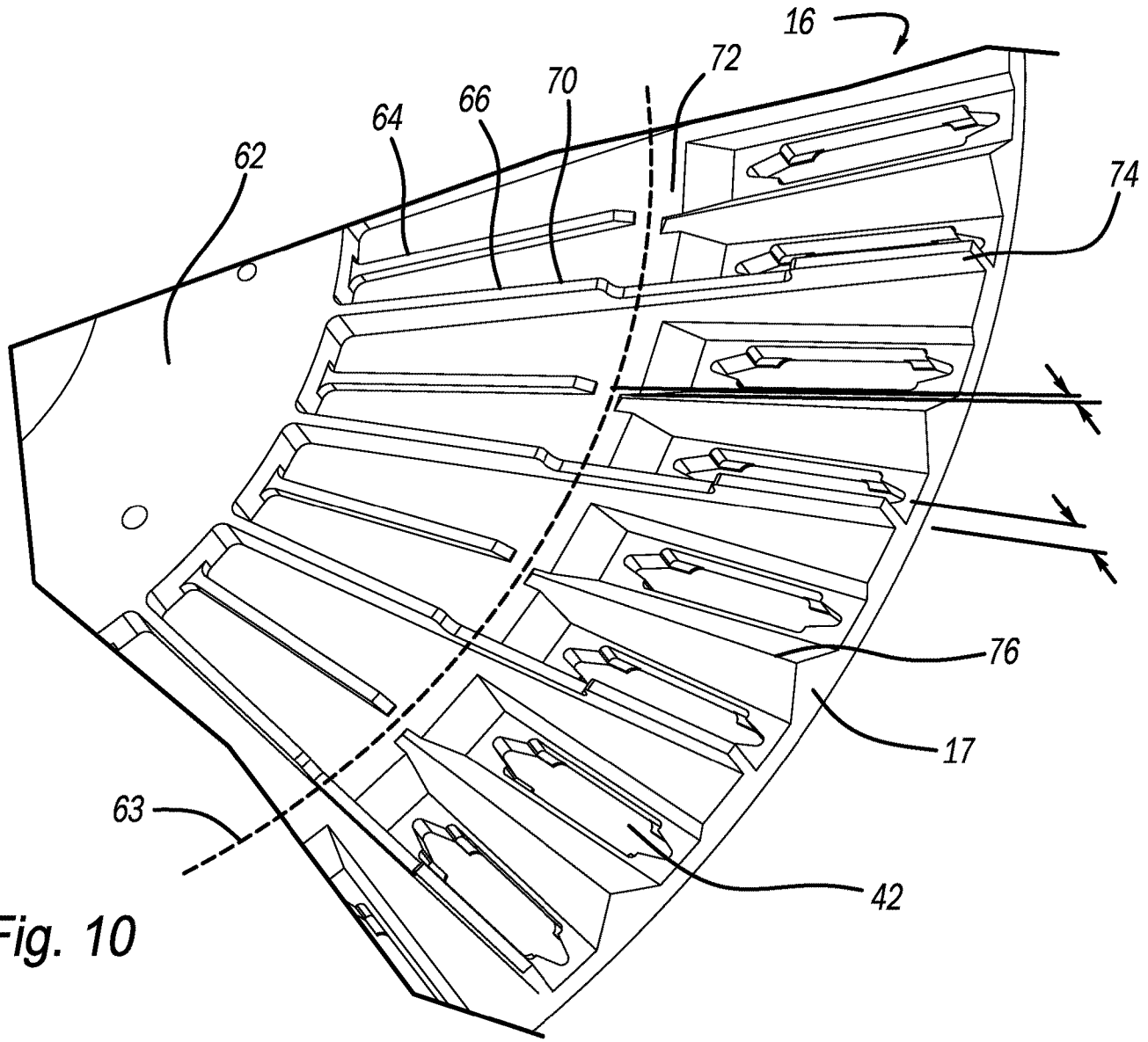
FIG. 10 is a cutaway pictorial view of the top surface of the collator plate.

Air jets 88 and 90 shown in FIG. 8 are optional features which can assist in agitating ammunition 14 and accelerating their escape into discharge chute 40.

The particular dimensions and relationships of the components described herein are especially adapted for processing a particular configuration of ammunition cartridges 14. For example, the angular spacing of vanes 64, 66 and 76, their heights, and certainly the dimensions and configuration of apertures 42 are highly related to a particular ammunition cartridge 14 design.

While the above description constitutes the preferred embodiment of the present invention, it will be appreciated that the invention is susceptible to modification, variation and change without departing from the proper scope and fair meaning of the accompanying claims.

What is claimed is:

1. A collator assembly adapted for orienting a plurality of assembled ammunition cartridges, each of the cartridges having a shell casing with a head, a necked down portion, a mouth, and a bullet installed within the mouth, the collator assembly further adapted to receive the plurality of ammunition cartridges in a disoriented matter and orienting them for discharge, comprising;

a machine mounting frame, a collator can fixedly mounted to the mounting frame, the collator can forming a circular can base with a discharge slot and an upstanding annular wall, a collator plate positioned within the collator can having a generally planar bottom surface closely spaced from the can base and an outer perimeter closely spaced from the inside of the annular wall, a drive motor for causing the collator plate to rotate within the collator can, and the collator plate further having a top surface forming a series of vanes extending radially from a central portion of the plate radiating outwardly toward the outer perimeter, a plurality of apertures positioned circumferentially around the collator plate adjacent to the outer perimeter and interleaved between the vanes, each of the collector plate apertures formed along a radial axis of the collator plate and having a perimeter edge symmetrical about the radial axis, and further symmetrical about a circumferential midplane axis, each of the apertures formed with a central portion having parallel side edges and providing clearance for passage of the cartridge shell casing, and end portions formed to provide clearance for passage of the bullet, and a pair of lands adjacent to the end portions which are narrowed to interfere with passage of the casing head, wherein upon rotation of the collator plate, one of the cartridges positioned within one of the plurality of apertures is supported by the collator can base and when the aperture overlies the discharge slot, the cartridge falls into a discharge chute, the aperture supporting the cartridge either in a radially outward or a radially inward orientation, the lands supporting the shell head as the cartridge falls through the aperture with the bullet oriented downwardly, thereby providing a stream of oriented ammunition cartridges falling into the discharge chute, further comprising, the collator plate having a central hub protruding from the central portion of the collator plate and a series of radially projecting diverter vanes, the central hub and the diverter vanes interrupting ammunition cartridges from dropping along the collator plate.

2. A collator assembly adapted for orienting a plurality of assembled ammunition cartridges, each of the cartridges having a shell casing with a head, a necked down portion, a mouth, and a bullet installed within the mouth, the collator assembly further adapted to receive the plurality of ammunition cartridges in a disoriented matter and orienting them for discharge, comprising;

a machine mounting frame, a collator can fixedly mounted to the mounting frame, the collator can forming a circular can base with a discharge slot and an upstanding annular wall, a collator plate positioned within the collator can having a generally planar bottom surface closely spaced from the can base and an outer perimeter closely spaced from the inside of the annular wall, a drive motor for causing the collator plate to rotate within the collator can, and the collator plate further having a top surface forming a series of vanes extending radially from a central portion of the plate radiating outwardly toward the outer perimeter, a plurality of apertures positioned circumferentially around the collator plate adjacent to the outer perimeter and interleaved between the vanes, each of the collector plate apertures formed along a radial axis of the collator plate and having a perimeter edge symmetrical about the radial axis, and further symmetrical about a circumferential midplane axis, each of the apertures formed with a central portion having parallel side edges and providing clearance for passage of the cartridge shell casing, and end portions formed to provide clearance for passage of the bullet, and a pair of lands adjacent to the end portions which are narrowed to interfere with passage of the casing head, wherein upon rotation of the collator plate, one of the cartridges positioned within one of the plurality of apertures is supported by the collator can base and when the aperture overlies the discharge slot, the cartridge falls into a discharge chute, the aperture supporting the cartridge either in a radially outward or a radially inward orientation, the lands supporting the shell head as the cartridge falls through the aperture with the bullet oriented downwardly, thereby providing a stream of oriented ammunition cartridges falling into the discharge chute, furthering comprising, the series of vanes including a plurality of first vanes extending from the central portion to the outer perimeter, the first vanes forming first, second and third portions radially extending away from the central portion, a plurality of second vanes interleaved between the first vanes extending from the central portion and terminating adjacent to an intermediate circle between the central portion and the outer perimeter, and a plurality of third vanes extending from adjacent to the intermediate circle to the outer perimeter interleaved between the first vanes, whereby the first portions of the first vanes have a greater height than the second vanes and the first vanes third portions having a different height than the third vanes.

3. The collator assembly in accordance with claim 2 further comprising, wherein the apertures are located between adjacent of the third portions of the first vanes and the third vanes.

4. The collator assembly in accordance with claim 2 further comprising, wherein an outer edge of the third vanes prevents the ammunition cartridges from being positioned in a circumferential direction between adjacent of the third portions of the first vanes.

5. The collator assembly in accordance with claim 2 further comprising, wherein the second portion of the first vanes are positioned radially outside the intermediate circle and have a height lower than the height of the third vanes.

6. A collator assembly adapted for orienting a plurality of assembled ammunition cartridges, each of the cartridges having a shell casing with a head, a necked down portion, a mouth, and a bullet installed within the mouth, the collator assembly further adapted to receive the plurality of ammunition cartridges in a disoriented matter and orienting them for discharge, comprising;

a machine mounting frame, a collator can fixedly mounted to the mounting frame, the collator can forming a circular can base with a discharge slot and an upstanding annular wall, a collator plate positioned within the collator can having a generally planar bottom surface closely spaced from the can base and an outer perimeter closely spaced from the inside of the annular wall, a drive motor for causing the collator plate to rotate within the collator can, and the collator plate further having a top surface forming a series of vanes extending radially from a central portion of the plate radiating outwardly toward the outer perimeter, a plurality of apertures positioned circumferentially around the collator plate adjacent to the outer perimeter and interleaved between the vanes, each of the collector plate apertures formed along a radial axis of the collator plate and having a perimeter edge symmetrical about the radial axis, and further symmetrical about a circumferential midplane axis, each of the apertures formed with a central portion having parallel side edges and providing clearance for passage of the cartridge shell casing, and end portions formed to provide clearance for passage of the bullet, and a pair of lands adjacent to the end portions which are narrowed to interfere with passage of the casing head, wherein upon rotation of the collator plate, one of the cartridges positioned within one of the plurality of apertures is supported by the collator can base and when the aperture overlies the discharge slot, the cartridge falls into a discharge chute, the aperture supporting the cartridges either in a radially outward or a radially inward orientation, the lands supporting the shell head as the cartridge falls through the aperture with the bullet oriented downwardly, thereby providing a stream of oriented ammunition cartridges falling into the discharge chute.

7. The collator assembly in accordance with claim 6 further comprising, a feed chute for dropping the ammunition cartridges into the collator can, as the collator plate is rotated.

8. The collator assembly in accordance with claim 6 further comprising, a discharge track receiving oriented ammunition cartridges from the discharge chute and feeding the cartridges toward a downstream operation.

9. The collator assembly in accordance with claim 6 further comprising the collector can, the circular can base and the collator plate are oriented at an angle between vertical and horizontal, whereby the ammunition cartridges loaded into the collector can tend to collect at a lower collection region of the collector can.

10. The collator assembly in accordance with claim 9 further comprising wherein the angle is about 30° measured from a horizontal plane.

* * * * *